US008527248B2

(12) United States Patent
Thambynayagam et al.

(10) Patent No.: US 8,527,248 B2
(45) Date of Patent: Sep. 3, 2013

(54) SYSTEM AND METHOD FOR PERFORMING AN ADAPTIVE DRILLING OPERATION

(75) Inventors: R. K. Michael Thambynayagam, Sugar Land, TX (US); Cengiz Esmersoy, Sugar Land, TX (US); Peter Gerhard Tilke, Belmont, MA (US); Maurice Nessim, Houston, TX (US); Annabelle Kania, Houston, TX (US); Sudhendu Kashikar, Katy, TX (US); Gregory P. Grove, Houston, TX (US); Nader C. Dutta, Houston, TX (US); Raj Banerjee, Abingdon (GB); Jeffrey B. Spath, Missouri City, TX (US); Christopher Hopkins, Katy, TX (US)

(73) Assignee: WesternGeco L.L.C., Houston, TX (US)

( * ) Notice: Subject to any disclaimer, the term of this patent is extended or adjusted under 35 U.S.C. 154(b) by 532 days.

(21) Appl. No.: 12/693,119

(22) Filed: Jan. 25, 2010

(65) Prior Publication Data

US 2010/0155142 A1 Jun. 24, 2010

Related U.S. Application Data

(63) Continuation-in-part of application No. 12/148,415, filed on Apr. 18, 2008, now Pat. No. 7,966,166, and a continuation-in-part of application No. 12/356,137, filed on Jan. 20, 2009.

(51) Int. Cl.
*G06G 7/48* (2006.01)

(52) U.S. Cl.
USPC ..... 703/10

(58) Field of Classification Search
USPC ..... 703/7, 10; 175/50; 702/6, 11, 13; 705/7
See application file for complete search history.

(56) References Cited

U.S. PATENT DOCUMENTS

| | | | |
|---|---|---|---|
| 5,842,149 | A | 11/1998 | Harrell et al. |
| 5,992,519 | A | 11/1999 | Ramakrishnan et al. |
| 6,233,524 | B1 | 5/2001 | Harrell et al. |
| 6,549,854 | B1 | 4/2003 | Malinverno et al. |
| 6,775,578 | B2 | 8/2004 | Couet et al. |
| 6,853,921 | B2 | 2/2005 | Thomas et al. |

(Continued)

FOREIGN PATENT DOCUMENTS

| | | |
|---|---|---|
| EP | 1263653 | 4/2006 |
| EP | 1825100 | 8/2007 |

(Continued)

OTHER PUBLICATIONS

Blacic et al., "Report on Conceptual Systems analysis of Drilling systems for 200-m-depth penetration sampling of the Martian subsurface", LOs Alamos National Laboratory, 2000.*

(Continued)

*Primary Examiner* — Kandasamy Thangavelu

(57) ABSTRACT

A system and method for performing an adaptive drilling operation is provided. The method involves obtaining data prior to drilling, constructing a base model with a base model unit from data obtained prior to drilling, constructing an overburden posterior model with an overburden model unit using the base model and data obtained from overburden drilling, constructing a reservoir posterior model with a reservoir model unit using the overburden posterior model and the data obtained from reservoir drilling and updating drilling operation based on the models.

29 Claims, 6 Drawing Sheets

(56) References Cited

U.S. PATENT DOCUMENTS

| | | | | |
|---|---|---|---|---|
| 6,912,491 | B1 | 6/2005 | van Bemmel | |
| 7,069,148 | B2 | 6/2006 | Thambynayagam et al. | |
| 7,181,380 | B2 | 2/2007 | Dusterhoft et al. | |
| 7,337,660 | B2 | 3/2008 | Ibrahim et al. | |
| 7,359,844 | B2 | 4/2008 | Sung et al. | |
| 7,430,501 | B2 | 9/2008 | Feraille et al. | |
| 7,460,957 | B2 | 12/2008 | Prange et al. | |
| 7,512,543 | B2 | 3/2009 | Raghuraman et al. | |
| 7,684,929 | B2 | 3/2010 | Prange et al. | |
| 7,725,302 | B2 | 5/2010 | Ayan et al. | |
| 7,876,705 | B2 | 1/2011 | Gurpinar et al. | |
| 7,966,166 | B2 | 6/2011 | Thambynayagam et al. | |
| 8,073,800 | B2 | 12/2011 | Prange et al. | |
| 8,352,227 | B2 | 1/2013 | Klumpen et al. | |
| 2003/0139916 | A1* | 7/2003 | Choe et al. | 703/10 |
| 2003/0168257 | A1 | 9/2003 | Aldred et al. | |
| 2003/0225606 | A1 | 12/2003 | Raghuraman et al. | |
| 2004/0220742 | A1* | 11/2004 | Mese et al. | 702/11 |
| 2004/0268338 | A1 | 12/2004 | Gurpinar et al. | |
| 2005/0096893 | A1 | 5/2005 | Feraille et al. | |
| 2005/0114031 | A1 | 5/2005 | Thambynayagm et al. | |
| 2005/0119911 | A1 | 6/2005 | Ayan et al. | |
| 2006/0151214 | A1 | 7/2006 | Prange et al. | |
| 2007/0112547 | A1 | 5/2007 | Ghorayeb et al. | |
| 2007/0156377 | A1 | 7/2007 | Gurpinar et al. | |
| 2007/0168133 | A1 | 7/2007 | Bennett et al. | |
| 2007/0168170 | A1 | 7/2007 | Thomas | |
| 2007/0285274 | A1 | 12/2007 | Esmersoy | |
| 2007/0294034 | A1* | 12/2007 | Bratton et al. | 702/6 |
| 2007/0299643 | A1 | 12/2007 | Guyaguler et al. | |
| 2008/0103743 | A1 | 5/2008 | Howell et al. | |
| 2008/0133194 | A1* | 6/2008 | Klumpen et al. | 703/10 |
| 2008/0179094 | A1 | 7/2008 | Repin et al. | |
| 2008/0300793 | A1* | 12/2008 | Tilke et al. | 702/13 |
| 2009/0056935 | A1 | 3/2009 | Prange et al. | |
| 2009/0157367 | A1* | 6/2009 | Meyer et al. | 703/10 |
| 2009/0187391 | A1* | 7/2009 | Wendt et al. | 703/7 |
| 2009/0192712 | A9* | 7/2009 | Karami | 702/6 |
| 2009/0260880 | A1 | 10/2009 | Thambynayagm et al. | |
| 2009/0271233 | A1* | 10/2009 | Prange et al. | 705/7 |
| 2009/0288881 | A1* | 11/2009 | Mullins et al. | 175/50 |
| 2010/0185427 | A1 | 7/2010 | Tilke et al. | |

FOREIGN PATENT DOCUMENTS

| | | |
|---|---|---|
| EP | 2150683 | 2/2010 |
| GB | 2405205 A | 2/2005 |
| WO | 2008150877 | 12/2008 |

OTHER PUBLICATIONS

Banerjee, R. et al., "A Method for Analysis of Pressure Response With a Formation Tester Influenced by Supercharging," 2006 SPE Russian Oil and Gas Technical Conference and Exhibition, SPE International, Oct. 3-6, 2006, pp. 1-7, SPE 102413, Moscow, Russia.

Brie, A., et al., "Quantitative Formation Permeability Evaluation from Stoneley Waves," 1998 SPE Annual Technical Conference and Exhibition, SPE International, Sep. 27-30, 1998, pp. 389-400, SPE 49131, New Orleans, Louisiana.

Busswell, G. et al., "Generalized Analytical Solution for Reservoir Problems With Multiple Wells and Boundary Conditions," 2006 SPE Intelligent Energy Conference and Exhibition, SPE International, Apr. 11-13, 2006, pp. 1-21, SPE 99288, Amsterdam, The Netherlands.

Chang, Yong, et al., "When Should We Worry About Supercharging in Formation Pressure While Drilling Measurements?," SPE/IADC Drilling Conference held in Amsterdam, SPE International, Feb. 23-25, 2005, pp. 1-15, SPE/IADC 92380, Amsterdam, The Netherlands.

Gilchrist, J. Phillip, et al., "Semi-analytical Solution for Multiple Layer Reservoir Problems with Multiple Vertical, Horizontal, Deviated and Fractured Wells," International Petroleum Conference, IPTC, Dec. 4-6, 2007, pp. 1-10, IPTC 11718, Dubai, U.A.E.

Hammond, P.S., et al., "Correcting Supercharging in Formation-Pressure Measurements Made While Drilling," SPE Annual Technical Conference and Exhibition, SPE International, Oct. 9-12, 2005, pp. 1-13, SPE 95710, Dallas, Texas USA.

Herron, M.M., et al., "A Robust Permeability Estimator for Siliciclastics," SPE Technical Conference and Exhibition, SPE International, Sep. 27-30, 1998, pp. 777-787, SPE 49301, New Orleans, Louisiana USA.

Ramakrishnan, T.S., et al., "Water Cut and Fractional Flow Logs from Array Induction Measurements," SPE Annual Technical Conference and Exhibition, SPE International, Oct. 6-9, 1996, pp. 83-98, SPE 36503, Denver, Colorado USA.

Chen, Shi et al., "A Well Test for In-Situ Determination of Relative Permeability Curves," SPE Annual Technical Conference and Exhibition, SPE International, Oct. 9-12, 2005, pp. 1-16, SPE 96414, Dallas, Texas USA.

Brehm, Andrew D.K. and Ward, Chris, D., "Pre-drill planning saves money," E&P, May 1, 2005, pp. 1-3, (website http://www.epmag.com/archives).

International Search Report and Written Opinion of PCT Application No. PCT/US2009/039459 (110.0176PCT) dated Aug. 3, 2009: pp. 1-8.

Combined Search and Examination Report of British Application No. GB0922596.2 (112.0008GB) dated Apr. 6, 2010: pp. 1-5.

International Search Report and Written Opinion of PCT Application No. PCT/US2011/022267 (110-0213-PCT) dated Jul. 15, 2011: pp. 1-8.

Examination Report of British Application No. GB1019338.1 (110.0176PCT/GB) dated Mar. 14, 2012: pp. 1-2.

Combined Search and Examination Report of British Application No. GB1217564.2 dated Oct. 12, 2012: pp. 1-4.

Agarwal, "SPE 8279: 'Real Gas Psuido-Time'—A New Function for Pressure Buildup Analysis of MHF Gas Wells," SPE AIME, 1979: pp. 1-12.

Akaike, "A New Look at the Statistical Model Identification," IEEE Transactions on Automatic Control, Dec. 1974, vol. AC-19(6): pp. 716-723.

Al-Hussainy et al., "The Flow of Real Gases Through Porous Media," Journal of Petroleum Technology, May 1966: pp. 624-636.

Al Omair, "Economic Evaluation of Smart Well Technology," A thesis, Texas A&M University Master of Science, May 2007: pp. 1-62.

Badru et al., "SPE 84191: Well Placement Optimization in Field Development," SPE International, 2003: pp. 1-9.

Bailey et al., "SPE 87026: Field Optimization Tool for Maximizing Asset Value," SPE International, 2004: pp. 1-10.

Beckner et al., "SPE 30650: Field Development Planning Using Simulated Annealing—Optimal Economic Well Scheduling and Placement," SPE International, 1995: pp. 209-221.

Böe et al., "SPE 65149: On Real Time Reservoir Management and Simulation While Drilling," SPE International, 2000: pp. 1-10.

Bourgeois et al., "Improving Well Placement with Modeling While Drilling," Oilfield Review, Winter 2006/2007: pp. 20-29.

Box et al., "Statistics for Experimenters: Design, Innovation, and Discovery," Second Edition, Wiley, 2005: p. 627.

Brehm et al., "Pre-drill planning saves money," E&P Magazine, May 2005: pp. 1-3, <http://www.epmag.com/item/print/EP-Magazine/archive/Pre-drill-planning-saves-money_2013>.

Burnham, " Multimodel inference: Understanding AIC and BIC in model selection," Amsterdam Workshop on Model Selection, Aug. 2004: pp. 1-93.

Busswell et al., "SPE 99288: Generalized Analytical Solution for Reservoir Problems with Multiple Wells and Boundary Conditions," SPE International, 2006: pp. 1-21.

Cullick et al., "SPE 84239: Optimizing Multiple-Field Scheduling and Production Strategy with Reduced Risk," SPE International, 2003: pp. 1-12.

Cullick et al., "SPE 96986: Optimal Field Development Planning of Well Locations with Reservoir Uncertainty," SPE International, 2005: pp. 1-12.

Durlofsky et al., "Advanced Techniques for Reservoir Simulation and Modeling of Nonconventional Wells," Final Report, Department of Petroleum Engineering, Aug. 2004: pp. 1-224.

Fanchi, "Shared Earth Modeling," Methodologies for Integrated Reservoir Simulations, Butterworth-Heinemann, 2002: pp. 5-11.

Gutteridge et al., "SPE 35503: Connected Volume Calibration for Well-Path Ranking," SPE International, 1996: pp. 197-206.
Güyagüler et al., "SPE 63221: Optimization of Well Placement in a Gulf of Mexico Waterflooding Project," SPE International, 2000: pp. 1-10.
Güyagüler et al., "Uncertainty Assessment of Well-Placement Optimization," SPE Reservoir Evaluation & Engineering, Feb. 2004: pp. 24-32.
Ierapetritou et al., "Optimal Location of Vertical Wells: Decomposition Approach," AIChE Journal, 1999, vol. 45 (4): pp. 844-859.
Luersen et al., "Globalized Nelder-Mead method for engineering optimization," Computers and Structures, 2004, vol. 82: pp. 1-10.
Narayanan et al., "SPE 79703: Better Field Development Decisions from Multi-Scenario, Interdependent Reservoir, Well, and Facility Simulations," SPE International, 2003: pp. 1-11.
Anonymous, "Pareto Chart," via the wayback machine, Feb. 2006: pp. 1-7, <http://personnel.ky.gov/nr/rdonlyres/d04b5458-97eb-4a02-bdel-99fc31490151/0/paretocharat.pdf>.
Primera et al., "SPE 99945: Simulation While Drilling: Utopia or Reality?" SPE International, 2006: pp. 1-11.
Raghavan, "SPE5588: Well Test Analysis: Wells Producing by Solution Gas Drive," Society of Petroleum Engineers Journal, 1975: pp. 196-208.
Raghuraman et al., "SPE 86568: Valuation of Technology and Information for Reservoir Risk Management," SPE Reservoir Evaluation & Engineering, Oct. 2003: pp. 307-315.
Rosenwald et al., "SPE 3981: A Method for Determining the Optimum Location of Wells in a Reservoir Using Mixed-Integer Programming," Society of Petroleum Engineers Journal, Feb. 1974: pp. 44-54.
Sakowski et al., "SPE 94672: Impact of Intelligent Well Systems on Total Economics of Field Devleopment," SPE International, 2005: pp. 1-15.
Santellani et al., "SPE 39754: Survival of the Fittest' an Optimi[z]ed Well Location Algorithm for Reservoir Simulation," SPE International, 1998: pp. 255-261.
Sarkar et al., "Fluid Flow Simulation in Fractured Reservoirs," Annual Consortium Meeting, MIT Earth Resources Library, 2002: pp. 1-31.
Seifert et al., "SPE 35520: Well Placement Optimi[z]ation and Risking using 3-D Stochastic Reservoir Modelling Techniques," SPE International, 1996: pp. 289-300.
Smiseth et al., "SPE 111693: DollarTarget—Optimize Trade-Off Between Risk and Return in Well Planning and Drilling Operations," SPE International, 2008: pp. 1-12.
Tatang et al., "An efficient method for parametric uncertainty analysis of numerical geophysical models," Journal of Geophysical Research, Sep. 1997, vol. 102(D18): pp. 21,925-21,932.
Yeten et al., "SPE 77565: Optimization of Nonconventional Well Type, Location and Trajectory," SPE International, 2002: pp. 1-14.

* cited by examiner

SYSTEM AND METHOD FOR PERFORMING AN ADAPTIVE DRILLING OPERATION

CROSS-REFERENCE TO RELATED APPLICATION

This application is a continuation-in-part application and claims under 35 U.S.C. §119(e), §120, §365(c), and/or Patent Rule 1.53(b), priority to and the benefit of U.S. patent application Ser. No. 12/148,415, filed on Apr. 18, 2008 now U.S. Pat. No. 7,966,166, and U.S. patent application Ser. No. 12/356,137, filed on Jan. 20, 2009. Both of these related applications are hereby incorporated by reference in their entirety.

BACKGROUND

The present invention relates to techniques for performing oilfield operations relating to subterranean formations having reservoirs therein. More particularly, the present invention relates to techniques for performing adaptive drilling operations based on predetermined and updated wellsite parameters.

Oilfield operations are typically performed to locate and gather valuable downhole fluids. Typical oilfield operations may include, for example, surveying, drilling, wireline testing, completions, production, planning, and oilfield analysis. One such operation is the drilling operation which involves advancing a drilling tool into the earth to form a wellbore. Key to the drilling operation is determining where and how to drill the wellbore.

Before drilling begins, a field development plan (FDP) may be prepared to define how the drilling operation will be performed. Data concerning a proposed field is considered, and an FDP designed to meet certain objectives for the field, such as maximizing value (e.g, maximum NPV), and reaching optimal reservoir locations. The FDP may include various operational specifications for performing drilling and other oilfield operations. For example, drilling specifications may specify items, such as platform locations, well or borehole trajectories, wellbore capacity, completion type, location, equipment, and/or flow rate.

While the FDP may provide a good plan for initiating drilling and other oilfield operations, many uncertainties may exist and events may be encountered during the actual drilling that could not be predicted. These uncertainties include drilling issues, such as hazards (e.g., obstacles, pressure kicks, failures, conflicts, geological abnormalities, etc.), constraints (e.g., physical, engineering, operational, financial, legal, etc.) and/or losses (e.g., equipment failure, blowouts, mud losses, equipment damage, missed targets, etc.) Attempts have been made to provide advanced techniques for making plans and predictions as described, for example, in U.S. Pat./Publication Nos. 2009/0260880, 2008/0300793, 2007/0285274 and 2005/0114031, as well as GB Patent No. 2405205.

Despite the existence of techniques for enhanced drilling operations there remains a need to design drilling operations based on a better understanding of the wellsite. It is desirable that such techniques take into consideration the effects of various stages of the drilling operation. It is further desirable that such techniques avoid certain drilling issues that may affect the efficiency of the drilling operation. Such techniques are preferably capable of one or more of the following, among others: optimizing drilling, optimizing objectives (e.g., NPV), reducing costs, reducing risks, reducing uncertainties, collecting data in real time, analyzing data in real time, updating operations in real time, adjusting operations in real time, providing a reliable analysis, providing efficient data acquisition, providing real-time characterization of the near well bore environment, providing real-time well plan updates, performing reliable interpretations sufficiently rapidly so as to be able to influence major decisions while drilling, setting casing in competent rock, preventing hazards and/or damage, dealing with constraints and providing trajectory control. Real-time may mean during the course of drilling, and may include any data collection and/or data analysis while drilling or during the course of drilling the well.

SUMMARY

The present invention relates to an integrated well optimization unit for performing an adaptive drilling operation at a wellsite. The well optimization unit has a transceiver operatively connected to a controller at the wellsite for communication therewith. The well optimization unit has a base model unit for generating a base model from pre-drilling data. The well optimization unit has an overburden model unit for generating an overburden posterior model based on the base model and wellsite data received during overburden drilling. The well optimization unit has a reservoir model unit for generating a reservoir posterior model based on the base model, the overburden posterior model and wellsite data received during reservoir drilling. The base model, the overburden posterior model, and the reservoir posterior model are integrated for passing data therebetween and whereby a drilling operation may be adapted as the models are generated.

The present invention relates to a method for performing an adaptive drilling operation at a wellsite. The method involves providing an integrated well optimization unit. The well optimization unit has a transceiver operatively connected to a controller for communication therewith. The well optimization unit has a base model unit for generating a base model from pre-drilling data. The well optimization unit has an overburden model unit for generating an overburden posterior model based on the base model and wellsite data received during overburden drilling. The well optimization unit has a reservoir model unit for generating a reservoir posterior model based on the base model, the overburden posterior model and wellsite data received during reservoir drilling. The method involves constructing the base model. The method involves constructing the overburden posterior model during overburden drilling. The method involves constructing the reservoir posterior model during reservoir drilling. The method involves integrating the base model, the overburden posterior model and the reservoir posterior model by passing data therebetween. The method involves modifying a well plan based on the integrated models.

The present invention relates to a method for performing an adaptive drilling operation at a wellsite. The method involves obtaining data prior to drilling. The method involves constructing a base model with a base model unit from data obtained prior to drilling. The method involves constructing an overburden posterior model with an overburden model unit using the base model and data obtained from overburden drilling. The method involves constructing a reservoir posterior model with a reservoir model unit using the overburden posterior model and the data obtained from reservoir drilling. The method involves updating drilling operation based on the models.

The present invention relates to a system for performing an adaptive drilling operation at a wellsite. The system has an oil rig having a downhole drilling tool for advancing into the Earth to form a wellbore. The system has at least one monitoring tool for obtaining data regarding the wellsite. The system has a well optimization unit. The well optimization unit has a base model unit for constructing a base model prior to drilling. The well optimization unit has an overburden model unit for constructing an overburden posterior model using the base model and data obtained while drilling in an overburden. The well optimization unit has a reservoir model unit for constructing a reservoir posterior model using the base model, the overburden posterior model and data obtained while drilling in a reservoir. The well optimization unit has a drilling trajectory unit for determining an initial trajectory based on the base model and modifying the drilling trajectory by integrating information from the overburden posterior model with data from the base model.

BRIEF DESCRIPTION OF THE DRAWINGS

The present embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DESCRIPTION OF EMBODIMENT(S)

The description that follows includes exemplary apparatus, methods, techniques, and instruction sequences that embody techniques of the present inventive subject matter. However, it is understood that the described embodiments may be practiced without these specific details.

Figure 1:
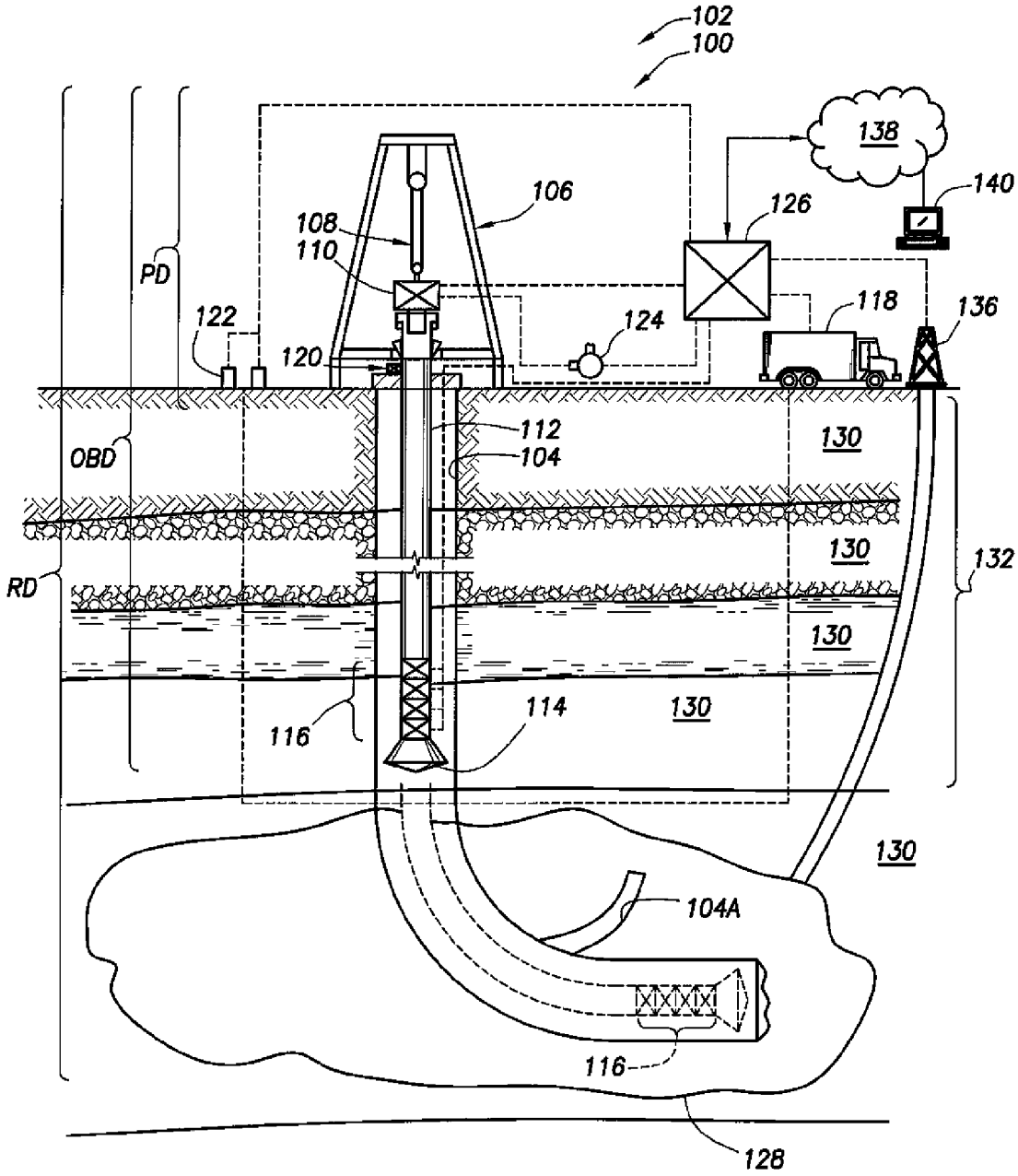
FIG. 1 is a schematic diagram depicting a system for performing an adaptive drilling operation, the system having a drilling tool suspended from a rig and advanced into a subterranean formation.

FIG. 1 depicts a schematic view of a wellsite 100 including a system 102 for performing an adaptive drilling operation to form a well 104, and any of its sidetracks 104A. As shown, the wellsite 100 is a land based wellsite, but could also be water based. The wellsite 100 may include any number of associated wellsite equipment, such as drilling tools, logging tools, sensors, production tools, and monitors such as a drilling rig 106, a hoisting device 108, a rotation inducing tool 110, a conveyance 112, a drill bit 114, at least one downhole monitoring tool 116, at least one surface monitoring tool (such as a seismic wave inducing tool 118, a pressure sensor 120, and at least one receiver 122), a fluid pumping system 124, and a controller 126.

The wellsite 100 may be configured to produce hydrocarbons from one or more reservoirs 128 located in a rock formation 130 beneath the earth's surface. Between the earth's surface and the reservoir 128 there may be any number of non-producing rock formations 130, know as an overburden 132.

The drilling rig 106 may be configured to advance the drill bit 114 into the earth in order to form the well 104. The hoisting device 108 may lift segments of the conveyance 112 in order to couple the segments into a string. The rotating drill bit 114 forms the well 104 as the conveyance 112 is advanced in the well 104. The conveyance 112 may be any suitable conveyance for forming the well 104 including, but not limited to, a drill string, a casing string, coiled tubing, and the like. The fluid pumping system 124 may be a pump for pumping drilling mud into the conveyance 112 to lubricate the drill bit, control formation pressure, and rotate the drill bit 114. The fluid pumping system 124 may further be used for the rock formation 130, and/or reservoir 128 stimulation treatments.

Additional downhole tools, devices and systems for drilling operations, completions operation and production operations may be used at the wellsite 100 such as drill bit steering tools, whipstocks, packers, downhole pumps, valves, and the like.

The controller 126 may send and receive data to and from any of the tools, devices and systems associated with the wellsite 100 and/or one or more additional wells 136. The system 102 may include a network 138 for communicating between the well-site 100 components, systems, devices and tools. Further, the network 138 may communicate with one or more offsite communication devices 140 such as computers, personal digital assistants, and the like. The network 138 and the controller 126 may communicate with any of the tools, devices and systems using any combination of communication devices or methods including, but not limited to, wired, telemetry, wireless, fiber optics, acoustic, infrared, a local area network (LAN), a personal area network (PAN), and/or a wide area network (WAN). The connection may be made via the network 138 to an external computer (for example, through the Internet using an Internet Service Provider) and the like.

The downhole monitoring tools 116 and surface monitoring tools 118 may include any device capable of detecting, determining, and/or predicting one or more wellsite conditions. The downhole monitoring tools 116 may include, for example, Logging While Drilling Tools (LWD), wire line tools, shuttle deployment type tools, deep imaging tools, deep imaging resistivity tools, optical probes mounted on the drill collar, electrical probes mounted on the drill collar, formation pressure while drilling tools (FPWD), production monitors, pressure sensors, temperature sensors, one or more receivers, and the like. The surface monitoring tools 118 may include, for example, a seismic truck 118 for inducing seismic waves into the earth and receivers 122 for receiving the seismic waves. Further, the receivers 122 may receive seismic waves generated by any seismic source including the drill bit, other noise sources, downhole tools, micro-seismic events, and the like. The monitoring tools 116 and 118 provided may be used to collect, send, and receive data concerning the well-site 100 to the controller 126.

The well 104 being drilled may be referred to as a production steered well. The production steered well may be created and/or operated in a manner that seeks to optimize one or more Figures of Merit (FOMs) in the drilling operation. Such FOMs may be any wellsite and/or drilling parameter, such as net present value (NPV), production rates, recovery factor, payback period, total production in a given period, percent of net, utility functions, or other factor which may be important to evaluate the operation. The production steered well may be formed using, for example, pre-drilling data in combination with real time overburden drilling data and real time reservoir drilling data to optimize the drilling operation. The production steered well may include three phases: (1) pre-drilling phase; (2) overburden drilling phase; and (3) reservoir drilling phase.

From the data collected during one or more of the three phases, the one or more FOMs may be determined and compared with predicted values. From the determined FOMs, the drilling operation may be modified in order to optimize the drilling operation according to the FOM. The system 102 may allow for real time characterization of the near well bore environment, real-time updating of the geological models, real time well plan updates to modify drilling speed, trajectory, mud weight, weight on drill bit, and/or tools used in order to avoid hazards, such as pressure kicks through pore pressure prediction and monitoring, and avoidance of mud loss due to geo-mechanical problems such as through fracture gradient prediction and monitoring.

Figure 2:
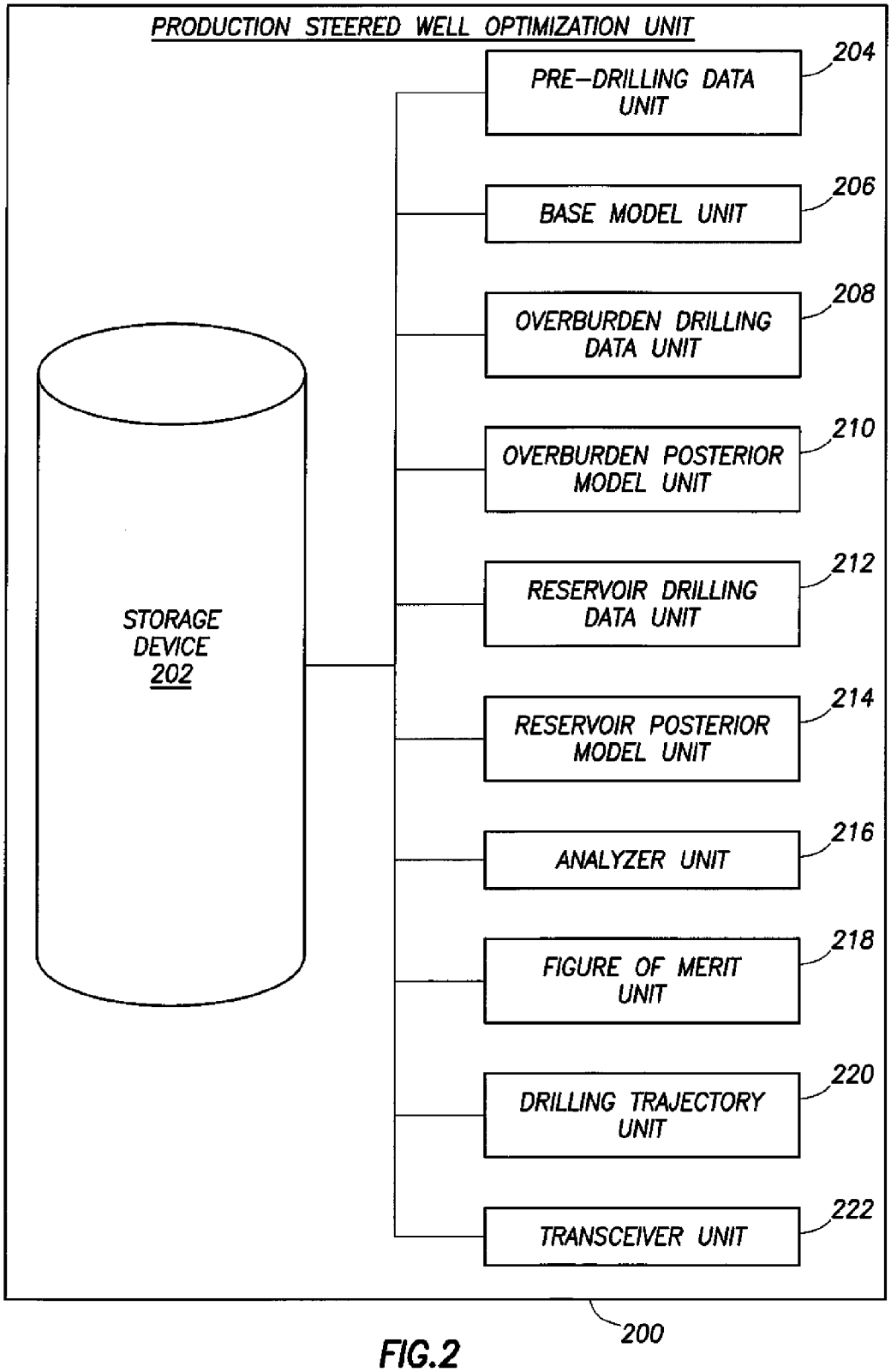
FIG. 2 is a block diagram illustrating a production steered well optimization unit usable with the system of FIG. 1.

FIG. 2 is a block diagram illustrating a production steered well optimization unit (sometimes referred to as a "well optimization unit") 200. The production steered well optimization unit 200 may be incorporated into or about the wellsite (on or off site) for operation in conjunction with the controller 126. The production steered well optimization unit 200 may include a storage device 202, a pre-drilling data unit 204, a base model unit 206, an overburden drilling data unit 208, an overburden posterior model unit 210, a reservoir drilling data unit 212, a reservoir posterior model unit 214, an analyzer unit 216, a Figure of Merit (FOM) Unit 218, a drilling trajectory unit 220 and a transceiver unit 222.

The storage device 202 may be any conventional database or other storage device capable of storing data associated with the system 102, shown in FIG. 1. Such data may include, for example, pre-drilling data, base models, overburden drilling data, overburden posterior models, reservoir drilling data, reservoir posterior models, one or more FOMs, drilling trajectories, and the like. The analyzer unit 216 may be any conventional device, or system, for performing calculations, derivations, predictions, analysis, and interpolation, such as those described herein. The transceiver unit 222 may be any conventional communication device capable of passing signals (e.g., power, communication) to and from the production steered well unit 200. The pre-drilling data unit 204, the base model unit 206, the overburden drilling data unit 208, the overburden posterior model unit 210, the reservoir drilling data unit 212, the reservoir posterior model unit 214, the analyzer unit 216, the FOM Unit 218, and the drilling trajectory unit 220 may be used to receive, collect and catalog data and/or to generate outputs as will be described further below.

The production steered well optimization unit 200 may take the form of an entirely hardware embodiment, an entirely software embodiment (including firmware, resident software, micro-code, etc.) or an embodiment combining software and hardware aspects. Embodiments may take the form of a computer program embodied in any medium having computer usable program code embodied in the medium. The embodiments may be provided as a computer program product, or software, that may include a machine-readable medium having stored thereon instructions, which may be used to program a computer system (or other electronic device(s)) to perform a process. A machine readable medium includes any mechanism for storing or transmitting information in a form (such as, software, processing application) readable by a machine (such as a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. Embodiments may further be embodied in an electrical, optical, acoustical or other form of propagated signal (e.g., carrier waves, infrared signals, digital signals, etc.), or wireline, wireless, or other communications medium. Further, it should be appreciated that the embodiments may take the form of hand calculations, and/or operator comparisons. To this end, the operator and/or engineer(s) may receive, manipulate, catalog and store the data from the system 102 in order to perform tasks depicted in the production steered well optimization unit 200.

The adaptive drilling operation may be performed using the system 102 of FIG. 1 and the optimization unit 200 of FIG. 2 to form a production steered well based on the three phases: (1) pre-drilling phase; (2) overburden drilling phase; and (3) reservoir drilling phase as described below.

Pre-Drilling Phase:

The goal of the pre-drilling phase is to construct a base model of the overburden 132 and the reservoir 128 that may be used to establish the initial well plan for drilling the well 104. The base model may be constructed using well-site data collected prior to the commencement of the drilling operation. The base model may be used to predict different drilling trajectories according to one or more of the FOMs. For example, the trajectories may be based on reducing cost and risk, while at the same time maximizing an FOM (e.g., the NPV).

The pre-drilling data unit 204 may be used to receive, collect and catalog pre-drilling data that is collected, received and/or predicted prior to the commencement of drilling. The pre-drilling data unit 204 may classify the pre-drilling data into two categories: a prior data deck and a prediction data deck. The pre-drilling data unit 204 may sort and/or catalog data received into the prior data deck and the prediction data deck.

The prior data deck may be a repository of information, or data, describing the basin (the overburden and the reservoir) before commencement of drilling. Much of the prior data deck may be deduced and/or derived by the pre-drilling data unit 204 prior to drilling from regional knowledge of the basin. The prior data deck may receive the wellsite data from any number of sources, such as the surface monitoring tools 118, the additional wells 136 in the region, operator knowledge, regional knowledge, history of the area, third party data, and the like. More specifically, the prior data deck may include, for example, the following: 3D Seismic Image with interpretation, borehole seismic, inversion generating rock and fluid property volumes with uncertainty, legal constraints, technology constraints, hydrocarbon potential from basin modeling studies, outcrops, rate of penetration (ROP), risk and cost attributes, properties that may influence the life of the well (such as sanding and strain rate), offset well drilling records including bottom hole assembly (BHA) performance reports and analysis, overburden and reservoir structural models, reservoir rock petro-physical properties, rock/fluid interaction, geomechanics, fluid contact, reservoir pressures and temperatures, sedimentary and structural geology, and/or reservoir fluid properties.

The overburden and reservoir structural models may include, for example, wellsite data concerning, for example, faulting and compartmentalization information. The reservoir rock petro-physical properties may include, for example, porosity distribution, compressibility, and permeability in both single and multiple porosity systems. The rock/fluid interaction may include, for example, capillary pressure curves, relative permeability curves (including endpoint variations) and hysteresis in these relationships. The geomechanics may include, for example, rock properties such as rock strength, fracturing, formation pressure, dependence of properties on pressure and temperature, fines migration, and onset of sanding. The fluid contact(s) may include, for example, standoff from Gas-Oil and Water-Oil contacts. The sedimentary and structural geology may estimate the position and nature of the reservoir thickness and lateral extent. The reservoir fluid properties may include, for example, information on the types of fluid phases that may occur in the simulation model (oil, water, gas, solids such as asphaltenes and sand) and the respective saturations, densities, viscosities, compressibility, expected phase behavior, reaction between injected and formation rock and formation fluids, formation fluid spatial distributions (such as a hydrocarbon compositional gradient and mud filtrate invasion depths). The prior data deck may serve as an initial data input for the drilling operation.

The prediction data deck may be, for example, predicted information regarding the basin, the wellsite 100 and/or surrounding wells. There may be a degree of uncertainty with all of the information in the prediction data deck. As the drilling commences, the degree of uncertainty may go down, as will be discussed below. The prediction data deck may use data from the prior data deck as a base for the prediction data. The prediction data deck may include, but is not limited to, any basin feature and/or wellsite feature that may be predicted prior to drilling, such as the expected flow rates of the well 104 and its sidetracks 104A, predicted flow rates of surrounding wells, the pressure constraints on the wells, and the economic criteria which will be used to optimize the value of the production from the well. The prediction data deck may be used to maximize and/or optimize any of the FOMs.

The base model unit 206 may receive data from the pre-drilling data unit 204 in order to construct the base model. The base model may include an overburden model and/or a reservoir model. Thus, the base model may be a model of the basin constructed by the base model unit 204 based on data obtained prior to the commencement of drilling. Due to the uncertainty associated with the prediction data deck, the base model may only be an estimate of the properties of the overburden and the reservoir.

Figure 3:
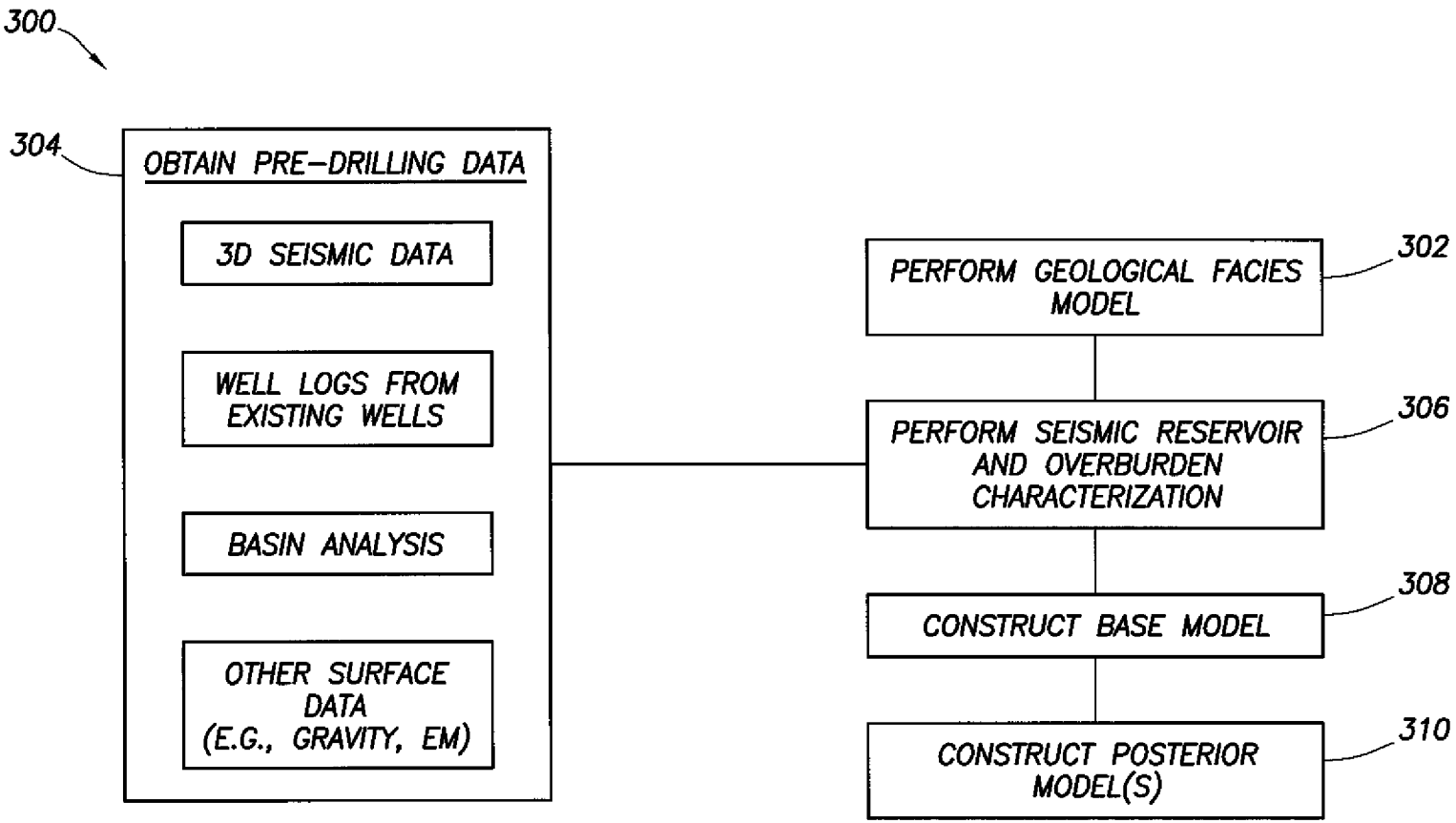
FIG. 3 depicts a flow diagram illustrating a method for performing a pre-drilling operation.

FIG. 3 is a flow diagram illustrating a method 300 of constructing the base model. The base model may be generated using, for example, the base model unit 206 of FIG. 2. The method involves performing 302 geological facies modeling. The geological facies modeling may involve any number of modeling techniques including, analog techniques, process modeling, and multipoint statistics. The method further involves obtaining (304) pre-drilling data. The pre-drilling data may be any data received from the pre-drilling data unit 204 (shown in FIG. 2), such as data from the prior data deck, the prediction data deck, the 3D seismic data, the well logs from existing wells, basin analysis, and/or other surface data (e.g. gravity and EM). The basin analysis may include the hydrocarbon potential of the reservoirs 130 (shown in FIG. 1) by assessing the probability of source rock and migration pathways.

The method further involves performing (306) seismic reservoir and overburden characterization using the pre-drilling data and/or the geological facies model. The characterization may be done using any number of methods such as characterization models for example Lithocube, pore pressure prediction, geobodies, interpretation and other characterization techniques. For example, the characterization analysis may integrate 3D and 4D seismic data with existing well log data (if available) to generate elastic rock properties and lithologic distributions. These properties and distributions have probabilities associated with them. Geo-mechanical properties such as stress tensor distribution for the overburden and reservoir may be used to form a regional mechanical earth model.

The method further involves constructing (308) the base model. As discussed above, the base model may include the overburden base model and the reservoir base model. The base model may be constructed by combining the 3D finite element property grids to generate new property models. The property models may include reservoir simulation properties such as porosity, permeability, pressure, saturation, and PVT. In the reservoir 130, shown in FIG. 1, these properties may describe the risk and cost of drilling and completing the well 104. These cost and risk properties, or property cubes, may be used to plan the well trajectories through the overburden and into the reservoir (as will be discussed in more detail below). Further, the property models may allow the overburden base model and the reservoir base model to be constructed. The constructed base model may further be used to construct (310) the overburden posterior models and the reservoir posterior models as will be discussed in more detail below.

The models generated herein may involve the use of one or more modeling techniques, such as those described in U.S. patent application Ser. No. 12/356,137 previously incorporated by reference herein and U.S. Patent Publication No. 2008/0300793.

The base model may be used to obtain an initial range for one or more of the FOMs. The FOM unit 218, as shown in FIG. 2, may base a well development plan on any number of FOMs. Initially there is large uncertainty in the FOM based on the uncertainty in the base model. As drilling starts, the FOM unit 218 receives new and/or updated data/models for the overburden and the reservoir. The FOM unit 218 may use the updated data/models to narrow the range of the FOM as the uncertainty is decreased.

In one example, the FOM is the NPV for the wellsite 100, as shown in FIG. 1. In this example:

$$NPV=f(OPT, C(\text{cost of well}))$$

The OPT may be the cumulative amount of oil that can be produced from the production steered well. It may be assumed that the well will be drilled into a reservoir containing a gas cap, an oil bearing zone and/or an aquifer. The C(cost of well) may be the total costs of starting and maintaining production from the well. As the uncertainty in the model decreases, the uncertainty in the FOM (the NPV) typically decreases. The FOM unit 218 may automatically update the FOM during the drilling operation in both the overburden and the reservoir. Thus, the value for the NPV decreases in uncertainty as drilling operations continue. The optimization of the NPV may be subject to the following constraints:

C1: C(starting-production)<C(capex-budget);
C2: T(production)<T(max);
C3: PR<PR(max);
C4: GOR(min)<GOR<GOR(max);
C5: BHP>BHP(min);
C6: THP>THP(min);
C7: P(reservoir)>P(abandonment);
C8: OPR>OPR(min);
C9: THT>THT(min); and
C10: C(maintaining-production)<C(opex-budget).

C(starting-production) may be the costs of bringing the well on line to start oil production. Factors which may contribute to C(starting-production) may include drilling the well, completion and tubular, artificial lift, flow assurance, required pipeline and surface processing facilities and well clean up. C(capex-budget) may be the capital expenditure budget which can be allocated for starting production. T(production) may be the time over which the oil is produced. T(max) may be the maximum time for which the well can be produced. PR, PR(max) are respectively the predicted and maximum allowable well water production rates. GOR, GOR(max), GOR (min) are respectively the predicted, maximum and minimum allowable producing gas oil ratios. BHP, BHP(min) are respectively the predicted and minimum allowable well bottom hole flowing pressures. THP, THP(min) are respectively the predicted and minimum allowable well tubing head flowing pressures. P(reservoir), P(abandonment) are respectively the predicted and minimum allowable reservoir pressures. OPR, OPR(min) are respectively the predicted and minimum allowable oil production rates. THT, THT(min) are respectively the predicted and minimum allowable well tubing head temperatures. C(maintaining-production) may be the recurring costs of maintaining production. C(opex-budget) may be the budget for operating expenditures. As uncertainty decrease in C1-C10 the uncertainty in the NPV typically decreases. FOM, such as NPV, may be determined using one or more techniques as described, for example, in U.S. Patent Publication No. 2009/0060880 and Ser. No. 12/356,137 previously incorporated by reference herein.

The drilling trajectory unit 220 may use the data from the base model and the FOM to determine an initial drilling trajectory, prior to drilling. Further, the drilling trajectory unit 220 may use the data from the overburden posterior model, the reservoir posterior model, and/or the FOM to determine one or more modified drilling trajectories, during drilling of the basin. The drilling trajectory unit 220 may also incorporate others aspects of the drilling trajectory such as hole size, casing size, casing depth, mud weights, etc. The drilling trajectory unit 220 may seek to reduce the cost of the well and its side tracks by reducing uncertainty in the overburden and reservoir. This may be accomplished by the drilling trajectory unit 220 updating the drilling trajectory during the drilling of the overburden and the reservoir thereby avoiding drilling hazards. The drilling trajectory unit 220 may maximize the value of the well 104, shown in FIG. 1, by landing the well 104 in one or more optimal reservoir locations. The cost and risk cubes that may be used to plan the drilling trajectory may be refined and updated during overburden and reservoir drilling. This may have the effect of focusing the cost and risk values for the drilling operation.

Overburden Drilling Phase

The objective of the overburden phase is to: (1) minimize uncertainty and risks to handle the drilling issues, and (2) to produce the best geological model of the reservoir prior to landing the well 104 in the reservoir 128 (see FIG. 1). During overburden drilling new measurements are consistently acquired that may be used to update the well plan during the drilling operation. The new measurements may be used to reduce the uncertainties of the subsurface formations and hazards near and below the advancing drill bit 114. The new measurements, or overburden data, may be used to construct and update an overburden posterior model while drilling.

The overburden drilling data unit 208 may receive, collect and catalog data collected during the drilling of the overburden. The data collected may be data from onsite measurements (e.g., LWD or wireline, well-site sensors, etc.), operator inputs, offsite data, analyzed data and/or other sources. The overburden drilling data unit 208 may further manipulate the raw overburden data received from the tools into information regarding the overburden and/or reservoir properties as will be discussed below. The overburden data may be collected, or measured, by any of the at least one downhole monitoring tool 116 and/or the at least one surface monitoring tool 118, as shown in FIG. 1. The overburden drilling data unit 208 may classify the overburden data into a while drilling (W-D) overburden data deck.

The W-D overburden data deck may be a repository of information acquired, processed and interpreted during overburden drilling. The W-D overburden data deck may include many parameters from the data acquired during the drilling of the well. For example, the W-D overburden data deck may include information from the base model, the prior data deck, the prediction data deck, real time data acquired from LWD tools, data acquired during various phases of drilling (such as casing points), data acquired via wired-drilled pipe, porosity, formation fluid saturations, permeability tensor, ratio of horizontal to vertical permeability, and geological heterogeneity and layering. In addition to the data and information included in the W-D overburden data deck described above, the overburden data deck may include any of the W-D data acquired, manipulated and/or cataloged using one or more techniques, such as those described in U.S. Patent Publication No. 2009/0060880 previously incorporated by reference herein.

The porosity may be measured by the LWD tools. The LWD porosity measurements may include, for example, neutron porosities, sigma and sonic derived porosities, formation bulk density derived porosities, and nuclear magnetic resonance porosities. The formation fluid saturations in the invaded zone, as well as the un-invaded zone, may be derived from the LWD measurements and may include, for example, nuclear capture cross section, resistivity measurements, NMR measurements, and carbon/oxygen measurements. The permeability tensor may be derived from the LWD measurements and may include, for example, pore size correlations from LWD nuclear magnetic resonance measurements, permeability estimation from LWD nuclear elemental spectroscopy, permeability estimation from LWD sonic measurements, porosity to permeability transformations, and image logs for secondary porosity estimation. The ratio of horizontal to vertical permeability may be estimated from techniques which may include, for example, resistivity anisotropy. The geological heterogeneity and layering may be inferred from any combination of surface seismic, bore hole seismic and/or LWD measurements and/or initial earth models. The initial earth model may include, for example, image logs, nuclear elemental spectroscopic logs, and deep imaging tools which may rely on detecting resistivity contrasts.

The overburden posterior model unit 210, shown in FIG. 2, may use the base model and the W-D overburden data deck to form an overburden posterior model. The overburden posterior model unit 210 may receive the W-D overburden data deck from the overburden drilling data unit 208. The overburden posterior model unit 210 may receive the base model from the base model unit 206. The overburden posterior model unit 210 may incorporate the W-D overburden data deck into the base model thereby forming the overburden posterior model and reducing the uncertainty in the model. The overburden posterior model may yield greater certainty of the geology ahead of the drill-bit 114, shown in FIG. 1. The overburden posterior model may be updated continuously as the W-D overburden data deck is updated. Further, the posterior overburden model may be updated periodically (continuously, or at discrete locations) when the drilling operation reaches one or more stations.

The stations may be defined as a point in the path of the drill bit 114, shown in FIG. 1. The point may be a location where a predefined workflow is executed. For example, the workflow may include interpretations and fast simulations being executed. The frequency of the station updates may depend on the information gathered for the W-D overburden data deck, the immediacy of the task at hand, a distance drilled, and/or an elapsed drilling time. For example, if the interpretation of the LWD logs and checkshots were to be sufficiently variant from the previous station, and/or the initial drilling trajectory, the overburden posterior model unit 210 may require a new station, and/or a complete update to the overburden posterior model. The updated overburden posterior models at the stations may be used by the drilling trajectory unit 220 to determine the drilling trajectory.

Figure 4:
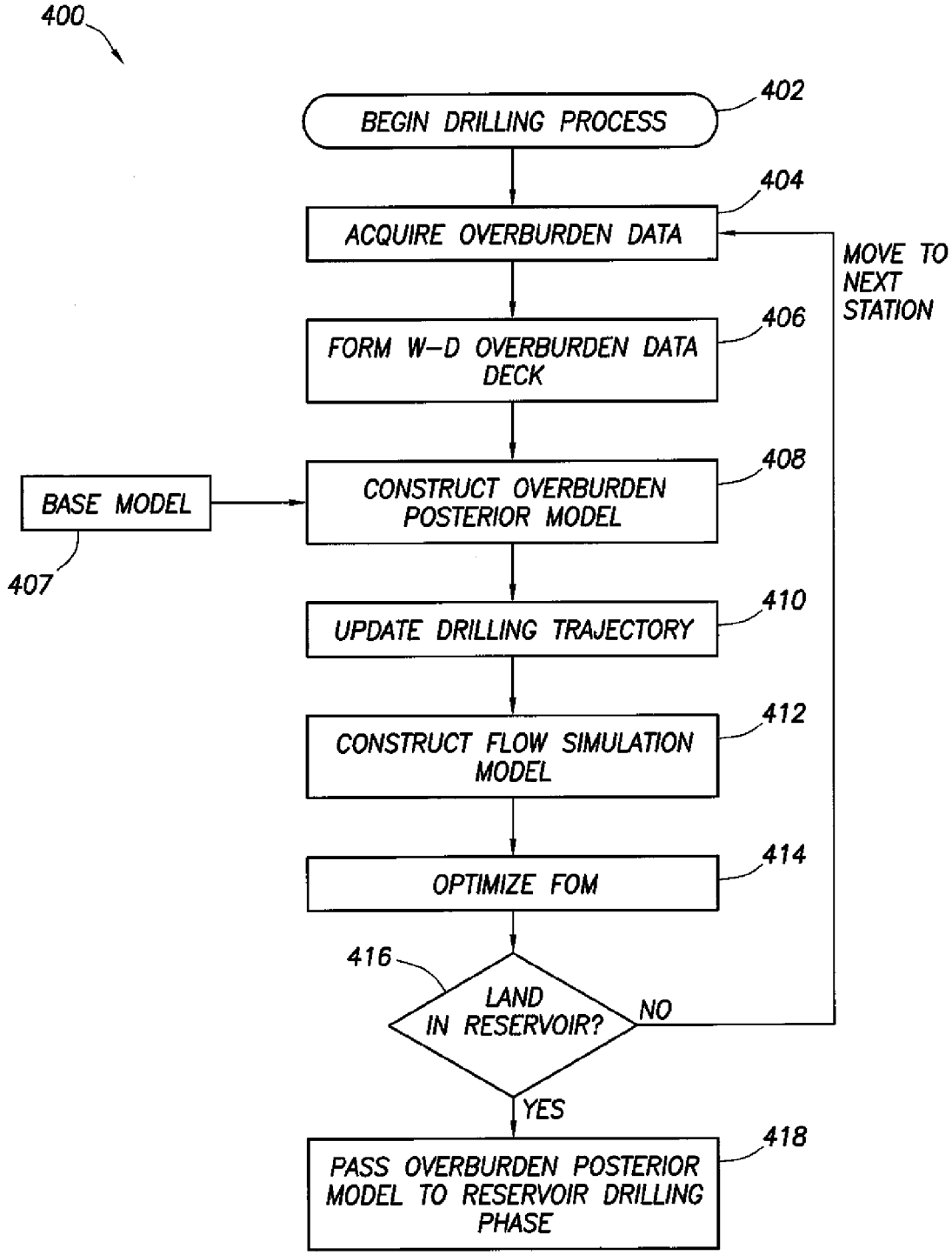
FIG. 4 depicts a flow diagram illustrating a method performing an overburden drilling operation.

FIG. 4 depicts a flow diagram 400 illustrating a method 400 performing an overburden drilling operation and of constructing the overburden posterior model that may be performed by the overburden posterior model unit 210, shown in FIG. 2. The method involves beginning (402) a drilling process, acquiring (404) the overburden data and forming (406) the W-D overburden data deck. The method further involves constructing (408) the overburden posterior model from the W-D overburden data deck and the constructed (407) base model. The overburden posterior model may be constructed upon reaching the first station. The overburden posterior model may be generated using Bayesian techniques. The new overburden posterior model may suggest the location of the next station.

The method further involves updating (410) the drilling trajectory. Updating the drilling trajectory may include updating drilling direction, casing point, hole size, mud weights, and the like. The method further involves constructing (412) a flow simulation model. The flow simulation models may use be constructed using one or more of the techniques as described in US Patent Publication No. 2005/0114031. The automated well design component of the drilling operation may then react by adjusting the well plan accordingly. The flow simulation models may update the reservoir drilling targets. The method further involves optimizing (414) the FOM in the FOM Unit 218, shown in FIG. 2 and discussed herein. For example, the FOM unit 218 may optimize the NPV subject to C1-C10 and predict a production estimate.

The method further involves determining (416) if the well has landed in the reservoir. If the well has not landed in the reservoir the drilling operation continues to the next station and the method returns to acquiring (404) overburden data. The overburden posterior model may be updated at the subsequent stations until the reservoir is reached. When the measurements, or the W-D overburden data deck vary from the overburden posterior model the overburden posterior model unit 210, shown in FIG. 2, may require an update of the overburden posterior model. If the reservoir is reached, the method involves passing (418) the overburden posterior model to the reservoir drilling phase.

Reservoir Drilling Phase

The objective during the reservoir drilling phase is to (1) design the trajectory of the production steered well so that the FOM (for example, the objective function of NPV) may be maximized, and (2) to obtain optimal placement of the well and its sidetracks. This drilling phase is similar to the overburden drilling phase. The tasks of the reservoir drilling phase may include, for example, periodic updates of the geological model, forward simulations, history matching and optimization. During the reservoir drilling phase a fast reservoir simulator may be used to estimate the expected production from the well and its possible sidetracks. The well plan, and/or FOMs, may be optimized during the reservoir drilling phase. During reservoir drilling new data is consistently acquired that may be used to construct and update a reservoir posterior model while drilling. The data collected may be data from onsite measurements (e.g., LWD or wireline, well-site sensors, etc.), operator inputs, offsite data, analyzed data and/or other sources.

The reservoir drilling data unit 212, shown in FIG. 2, may receive, collect and catalog data collected during the drilling of the reservoir. The reservoir data unit 212 may further manipulate the raw reservoir data received from the monitoring tools 116 and 118, as shown in FIG. 1, into information regarding the reservoir and/or reservoir properties as will be discussed below. The reservoir drilling data unit 212 may classify the reservoir data into a while drilling (W-D) reservoir data deck.

The W-D reservoir data deck may be a repository of information acquired, processed and interpreted during reservoir drilling. The W-D reservoir data deck may include many parameters from the data acquired during the drilling of the well. For example, the W-D reservoir data deck may include the overburden posterior model from the last station of the overburden (and/or any of the stations in overburden), real time data acquired from the one or more downhole monitoring tools 116, the overburden data deck from the last station of the overburden (and/or any of the stations in the overburden), near wellbore phenomena, reservoir scale phenomena, near wellbore pressures, wellbore hydraulic behavior, filtrate invasion, flow from the formation, the geo-mechanical effects, average reservoir pressures, densities of fluids which are in the formation, depths of the reservoir fluid contacts, capillary pressure curves, two phase relative permeability curves, and/or hydraulic behavior.

The near bore phenomena may include, for example, rate and depth of invasion of mud filtrate, supercharging of the pressures measured while drilling, filtrate clean up behavior observed when pumping fluids from various locations along the well, fluid produced if and when the well is being drilled underbalanced, evidence of formation fluids gathered by analysis of drilling cuttings, pretests from formation pressure while drilling measurements, and pressure and rate transient data (if available from neighboring wells). The reservoir scale phenomena may include, for example, spatial distributions of the pressure of the reservoir fluids, reservoir fluid distributions, and reservoir geo-mechanical properties. The spatial distributions of the pressures of the reservoir may include, for example, the formation fluid pressure distributions which may have been measured while drilling and which may have been integrated into a regional pore pressure model. The reservoir fluid distributions may include, for example, the reservoir fluid distributions inferred from downhole fluid analysis measurements acquired from the well. The reservoir geo-mechanical properties may include, for example, stress tensor distribution coming from a regional mechanical earth model. The near wellbore pressures may be measured by the FPWD tool.

Supercharging and other distortions on the pressures may be corrected by established methods. The pressures may then be processed to provide information on the average reservoir pressures within the drainage region of the well. The pressures may further be processed to provide the densities of the fluids which are in the formation intersected by the well and depths of the reservoir fluid contacts. The fluid contact depths may be inferred from LWD measurements that may include, for example, pressure gradients inferred from FPWD measurements, deep image resistivity tools, and downhole analysis of formation fluids. The capillary pressure curves may be inferred from various sources including LWD logs, such as NMR and array resistivities. Data to infer capillary pressures may also come from the pressures measured by the FPWD tool. The two phase relative permeability curves may be inferred from knowledge of the mud filtrate invasion, such as flare processing on array resistivity invasion profiles, and/or observing how the filtrate contamination diminishes when formation fluids are pumped back into the well bore. In addition to the data and information included in the W-D reservoir data deck described above, the reservoir data deck may include any of the W-D data acquired, manipulated and/or cataloged. Such data acquisition and/or cataloging may be performed using one or more of the techniques as described in U.S. Patent Publication No. 2009/0060880 previously incorporated by reference herein.

Figure 5:
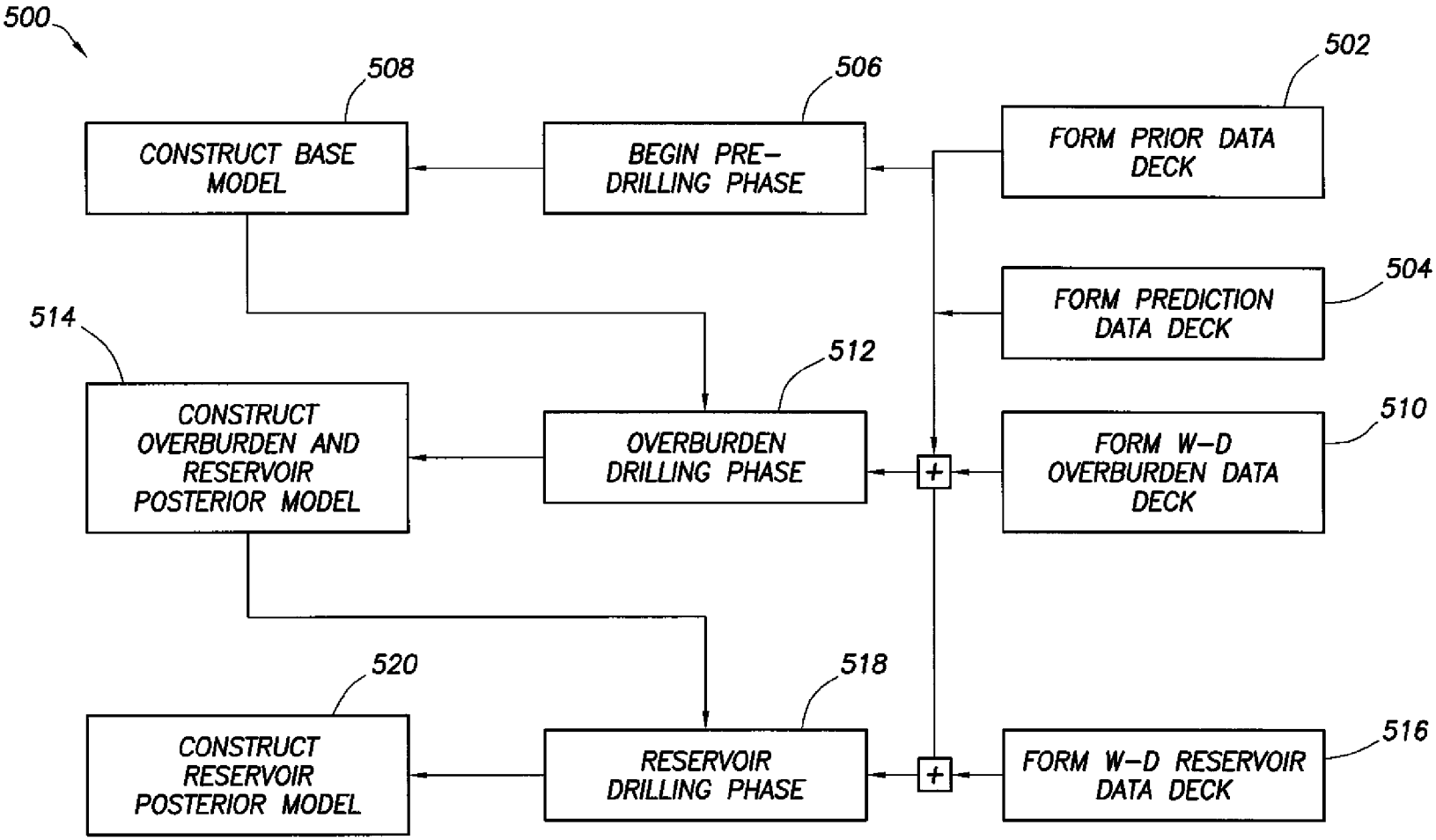
FIG. 5 depicts a flow diagram illustrating a method for constructing a base model, the overburden posterior model and the reservoir posterior model.

FIG. 5 depicts a flow diagram illustrating a method (500) for constructing a base model, the overburden posterior model and the reservoir posterior model. The method involves forming (502) the prior data deck and forming (504) the prediction data deck. The prior data deck and the prediction data deck are used (506) in the pre-drilling phase to construct (508) the base model. The method further involves forming (510) the W-D overburden data deck with the prior data deck, the prediction data deck and overburden data collected during (512) the overburden drilling phase. The method further involves constructing (514) the overburden and reservoir posterior models from the overburden data deck, which may include the prior data deck, the prediction data deck, and the base model. The method further involves forming (516) the reservoir data deck from the prior data deck, the prediction data deck, the W-D overburden data deck and measurements obtained during (518) the reservoir drilling phase. The method further involves constructing (520) a reservoir posterior model form the W-D reservoir data deck, which may include the prior data deck, the prediction data deck, the W-D overburden data deck, and the overburden posterior model.

The reservoir posterior model unit 214, shown in FIG. 2, may use the base model, the overburden posterior model(s), the prior data deck, the prediction data deck, the W-D overburden data deck and the W-D reservoir data deck to form a reservoir posterior model. The reservoir posterior model unit 214 may receive the prior data deck and the prediction data deck from the pre-drilling data unit 204. The reservoir posterior model unit 214 may receive the W-D overburden data deck from the overburden drilling data unit 208. The reservoir posterior model unit 214 may receive the base model from the base model unit 206. The reservoir posterior model unit 214 may receive the overburden data deck from the overburden drilling data unit 208. The reservoir posterior model unit 214 may receive the overburden posterior model from the overburden posterior model unit 210. The reservoir posterior model unit 214 may receive the reservoir data deck from the reservoir drilling unit 212. The reservoir posterior model unit 214 may incorporate the W-D overburden data deck and the reservoir data deck into the base model and/or overburden posterior model thereby forming the reservoir posterior model and reducing the uncertainty in the model(s). The reservoir posterior model may yield greater certainty of the geology in the reservoir 128 and ahead of the drill-bit 114, shown in FIG. 1. The reservoir posterior model may be updated continuously as the W-D reservoir data deck is updated. Further, the reservoir posterior model may be updated periodically when the drilling operation reaches the one or more stations. The stations in the reservoir may be determined in a similar manner as the stations are determined in the overburden drilling phase, and discussed above.

The reservoir posterior model in conjunction with the prediction data deck may be capable of predicting the well production performance. Further, the reservoir posterior model may be used to design the drilling trajectory so that the FOM and/or the objective function of the NPV may be maximized. The reservoir posterior model may reduce uncertainties in the input parameters by calculating a range of predicted NPV of the well.

Figure 6:
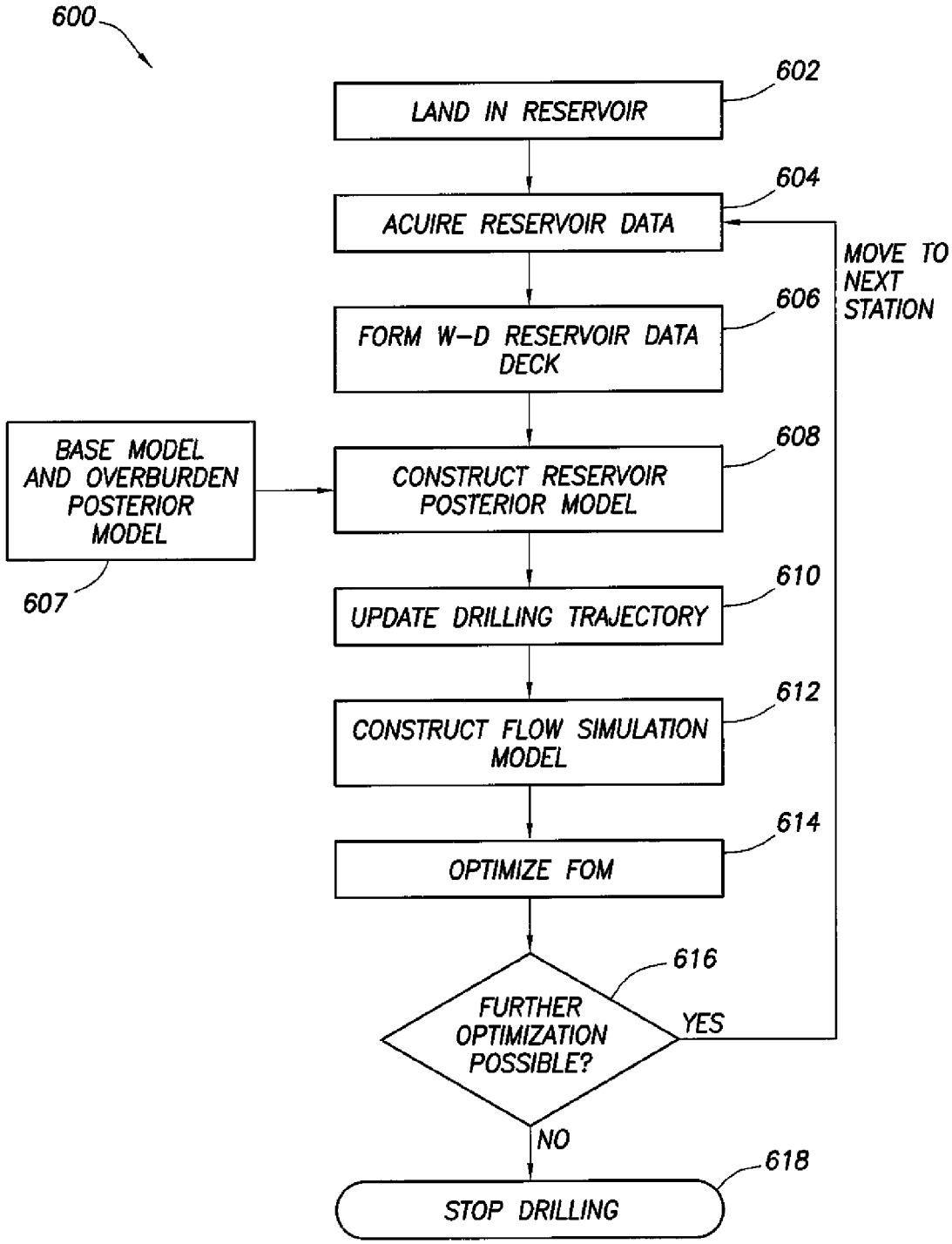
FIG. 6 depicts a flow diagram illustrating a method for performing an adaptive drilling operation.

FIG. 6 depicts a flow diagram illustrating a method 600 for performing a reservoir drilling operation and for constructing the reservoir posterior model that may be performed by the reservoir posterior model unit 214, shown in FIG. 2. The method involves landing (602) the well in the reservoir, acquiring (604) the reservoir data and forming (606) the W-D reservoir data deck. The method further involves constructing (608) the reservoir posterior model from the W-D reservoir data deck and the constructed (607) base model and overburden posterior model. The reservoir posterior model may be constructed upon reaching the reservoir and/or the first station in the reservoir. The reservoir posterior model may be generated using Bayesian techniques. The new reservoir posterior model may suggest the location of the next station.

The method further involves updating (610) the drilling trajectory. Updating the drilling trajectory may include updating drilling direction, casing point, hole size, mud weights, and the like. The method further involves constructing (612) a flow simulation model. The flow simulation models may be created in a similar manner as described for the overburden drilling phase. The flow simulation models may update the reservoir drilling targets. The depth and thickness of layers used in the simulation model may be constructed at each of the reservoir stations using the interpretation of the measurements. The data from the LWD logs may be integrated by using existing log analysis methods to provide continuous values of porosity, fluid saturations, permeability and two-phase relative permeabilities. The integration procedure may also allow the use of non-LWD data, such as that from core analysis. The depths of the fluid contacts, the associated properties of the fluids, and the distributions of capillary pressures may be inferred from some of the measurements referred to above. A three dimensional layered model of the reservoir may then be constructed. The three dimensional layered model may also account for hydraulic behavior in the wellbore during drilling of the well. Further, the three dimensional layered model may forecast the impact of the production steered well on future production from the field. The three dimensional layered model may contain the production steered well and perhaps other wells in the reservoir. The three dimensional layered model may be created by methods, such as inversion of seismic data, artificial neural networks, to recognize layering from the LWD logs, and geostatstics to create property distributions. The constructed three dimensional layered model may be used with other modeling techniques to perform analysis and simulations.

The three dimensional layered model of the reservoir may be converted to a simulation model of the reservoir in order to enter the history matching mode. The history matching mode may involve correction of log derived permeability by matching model generated pressure with actual transient FPWD pressure. During this process, correction for supercharging effects due to the invasion of drilling fluid may be performed. The history matching process may also result in a calculation of formation skin for the well. Further, the W-D reservoir data deck may be history matched to reproduce relevant observations. The history matching may be based on one or more simulation techniques, such as those described in US Patent Publication No. 2005/0114031.

The simulation may be a fast gridless analytical simulator which is particularly suitable for handling pressure and rate transient data. The generalized analytical simulator may support horizontal, vertical and deviated wells in a multilayer heterogeneous reservoir. The reservoir boundary may be modeled as no-flow or constant pressure (signifying an aquifer) or combination of both. The simulator may model both naturally fractured (dual porosity) reservoirs and hydraulic fractures at individual wells. The hydraulic fracture model may account for non-Darcy flow in the fracture. Even though the well is represented by a line source, suitable industry standard correction may be applied to account for wellbore storage effects and finite wellbore radius. The wells may have finite and infinite conductivity hydraulic fractures. Interference effects from multiple wells may be simulated.

After the history matching is complete, the uncertain geological model of the reservoir, the W-D reservoir data deck and the prediction data deck may be combined to create an ensemble of simulation models that reflect the uncertainty in the reservoir model. Collectively these models may be used to model the impact of the production steered well on future production from the field. Techniques, such as upscaling and downscaling, may be used prior to the flow simulation.

The simulation models may be used to optimize the FOM. The method, shown in FIG. 6, may further involve optimizing (614) the FOM in the FOM Unit 218, shown in FIG. 2 and discussed herein. For example, the FOM unit 218 may optimize the objective function of the NPV subject to C1-C10, the predicted production estimate, and the pressure-production performance of the well.

The method further involves determining (616) if further optimization of the reservoir is possible. If further optimization is possible, the reservoir drilling operation continues to the next station and the method returns to acquiring (604) reservoir data. The reservoir posterior model may be updated at subsequent stations until the no further optimization is possible. When the measurements or the W-D reservoir data deck vary from the reservoir posterior model, the reservoir posterior model unit 214, shown in FIG. 2, may require an update of the reservoir posterior model. If further optimization is not possible, the method involves stopping (618) drilling. Drilling may be terminated when the modeling from the production steered well indicates it is unlikely that the FOM may be optimized.

While the embodiments are described with reference to various implementations and exploitations, it will be understood that these embodiments are illustrative and that the scope of the inventive subject matter is not limited to them. Many variations, modifications, additions and improvements are possible. For example, models may be generated across one or more wells in a field for performing the methods described.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An integrated well optimization unit for performing an adaptive drilling operation at a wellsite, the unit comprising:

a transceiver operatively connected to a controller at the wellsite for communication therewith;

a base model unit for generating a base model from pre-drilling data;

an overburden model unit for generating an overburden posterior model based on the base model and wellsite data received during overburden drilling; and a reservoir model unit for generating a reservoir posterior model based on the base model, the overburden posterior model and wellsite data received during reservoir drilling;

wherein the base model, the overburden posterior model, and the reservoir posterior model are integrated for passing data therebetween and whereby a drilling operation is adapted as the models are generated.

2. The integrated well optimization unit of claim 1, wherein the drilling operation is adapted by changing a drilling trajectory.

3. The integrated well optimization unit of claim 2, further comprising a drilling trajectory unit for modifying the drilling trajectory from information obtained from the generated models.

4. The integrated well optimization unit of claim 3, wherein modifying the drilling trajectory further comprises any one of modifying a casing point, a hole size, and mud weights.

5. The integrated well optimization unit of claim 1, wherein the drilling operation is adapted by changing a mud weight.

6. The integrated well optimization unit of claim 1, wherein the drilling operation is adapted by changing a weight on a drill bit.

7. The integrated well optimization unit of claim 1, wherein the drilling operation is adapted by abandoning drilling operations.

8. The integrated well optimization unit of claim 1, further comprising a figure of merit unit for optimizing at least one well parameter.

9. A method for performing an adaptive drilling operation at a wellsite, comprising:

providing an integrated well optimization unit, comprising:

a transceiver operatively connected to a controller for communication therewith;

a base model unit for generating a base model from pre-drilling data;

an overburden model unit for generating an overburden posterior model based on the base model and wellsite data received during overburden drilling; and a reservoir model unit for generating a reservoir posterior model based on the base model, the overburden posterior model and wellsite data received during reservoir drilling;

constructing the base model;

constructing the overburden posterior model during overburden drilling;

constructing the reservoir posterior model during reservoir drilling;

integrating the base model, the overburden posterior model and the reservoir posterior model by passing data therebetween; and modifying a well plan based on the integrated models.

10. The method of claim 9, wherein modifying the well plan further comprises changing a mud weight.

11. The method of claim 9, wherein modifying the well plan further comprises changing a weight on a drill bit.

12. The method of claim 9, wherein modifying the well plan further comprises abandoning drilling operations.

13. The method of claim 9, further comprising modifying a figure of merit, wherein the figure of merit is the net present value (NPV).

14. The method of claim 13, further comprising reducing uncertainty in the NPV during drilling by optimizing at least one objective function of the NPV from the collected data during drilling.

15. The method of claim 9, wherein modifying the well plan further comprises modifying the a drilling trajectory.

16. The method of claim 9, wherein modifying the well plan further comprises changing a drilling speed.

17. The method of claim 9, wherein modifying the well plan further comprises changing a drill bit.

18. A method for performing an adaptive drilling operation at a wellsite, comprising:

obtaining data prior to drilling;

constructing a base model with a base model unit from data obtained prior to drilling;

constructing an overburden posterior model with an overburden model unit using the base model and wellsite data received during overburden drilling;

constructing a reservoir posterior model with a reservoir model unit using the overburden posterior model and the data obtained from reservoir drilling; and updating drilling operation based on the models.

19. The method of claim 18, further comprising integrating the models by passing data between the models.

20. The method of claim 18, further comprising optimizing at least one figure of merit.

21. The method of claim 20, further comprising changing a drilling trajectory based on the figure of merit.

22. The method of claim 20, wherein optimizing at least one figures of merit further comprises optimizing production.

23. The method of claim 18, further comprising constructing a flow simulation model.

24. A system for performing an adaptive drilling operation at a wellsite, comprising:

an oil rig having a downhole drilling tool for advancing into the Earth to form a wellbore;

at least one monitoring tool for obtaining data regarding the wellsite;

a well optimization unit comprising:

a base model unit for constructing a base model prior to drilling;

an overburden model unit for constructing an overburden posterior model using the base model and data obtained while drilling in an overburden;

a reservoir model unit for constructing a reservoir posterior model using the base model, the overburden posterior model and data obtained while drilling in a reservoir; and a drilling trajectory unit for determining an initial trajectory based on the base model and modifying the drilling trajectory by integrating information from the overburden posterior model with data from the base model.

25. The system of claim 24, wherein the drilling trajectory unit is for modifying the drilling trajectory by integrating information from the reservoir posterior model with data from at least one of the base model and the overburden posterior model.

26. The system of claim 24, wherein the well optimization unit further comprises a pre-drilling data unit for constructing a prior data deck and a prediction data deck.

27. The system of claim 24, wherein the well optimization unit further comprises an overburden data unit for constructing an overburden data deck.

28. The system of claim 24, wherein the well optimization unit further comprises a reservoir data unit for constructing a reservoir data deck.

29. The system of claim 24, wherein the well optimization unit further comprises a figure of merit unit for optimizing at least one well parameter.

* * * * *